US009258078B2

(12) United States Patent
Kang et al.

(10) Patent No.: US 9,258,078 B2
(45) Date of Patent: Feb. 9, 2016

(54) APPARATUS AND METHOD FOR TRANSMITTING JAMMING SIGNAL

(71) Applicant: KOREA ADVANCED INSTITUTE OF SCIENCE AND TECHNOLOGY, Daejeon (KR)

(72) Inventors: Joon Hyuk Kang, Seoul (KR); Seong Ah Jeong, Seoul (KR); Keon Kook Lee, Daejeon (KR); Dae Han Ha, Jeju-si (KR)

(73) Assignee: KOREA ADVANCED INSTITUTE OF SCIENCE AND TECHNOLOGY (KR)

( * ) Notice: Subject to any disclaimer, the term of this patent is extended or adjusted under 35 U.S.C. 154(b) by 37 days.

(21) Appl. No.: 14/190,423

(22) Filed: Feb. 26, 2014

(65) Prior Publication Data

US 2015/0244495 A1 Aug. 27, 2015

(51) Int. Cl.
*H04K 3/00* (2006.01)

(52) U.S. Cl.
CPC ..... *H04K 3/827* (2013.01); *H04K 2203/16* (2013.01); *H04K 2203/32* (2013.01)

(58) Field of Classification Search
CPC ..... H04K 3/45; H04K 3/42; H04K 3/44; H04K 1/02; H04K 3/43; H04K 2203/16; H04K 2203/32; H04K 1/00; H04K 3/41; H04K 3/825; H04K 2203/24; H04K 3/228; H04K 3/68; H04K 3/92; H04K 2203/34
See application file for complete search history.

(56) References Cited

U.S. PATENT DOCUMENTS

2012/0214404 A1* 8/2012 Shany et al. ..... 455/1
2014/0170963 A1* 6/2014 Delaveau et al. ..... 455/1
2014/0329485 A1* 11/2014 Calin et al. ..... 455/296

* cited by examiner

*Primary Examiner* — Golam Sorowar
(74) *Attorney, Agent, or Firm* — Cantor Colburn LLP

(57) ABSTRACT

A node device is provided. The node device includes forming a jamming signal generation unit configured to generate a jamming signal for a target signal which is transmitted from a base station to an intended receiving device supposed to receive the signal and an unintended receiving device not supposed to receive the signal, a beamforming vector determination unit configured to determine a beamforming vector of the jamming signal based on an amplitude of a received power of the jamming signal at the intended receiving device, and a transmission unit configured to transmit the jamming signal based on the determined beamforming vector.

7 Claims, 5 Drawing Sheets

APPARATUS AND METHOD FOR TRANSMITTING JAMMING SIGNAL

TECHNICAL FIELD

The various embodiments described herein pertain generally to an apparatus and method for transmitting a jamming signal.

BACKGROUND

Unlike wired communications systems, wireless communications systems transmit radio signals in a broadcasting manner. Thus, in a mobile radio communications network with multiuser settings, there always exists a risk of wiretapping by internal users who share the same resources. Conventionally, in establishing security of the wireless communications systems in a network layer, a wiretapper is allowed to receive a transmitted data. Accordingly, if the wiretapper devotes some time to analyzing codes of the received data, leakage of confidential or personal information may occur anytime. Thus, in a modern society where security issue is getting more important, there has been a demand for a technology that enables blocking reception of transmitted data by a wiretapper.

Meanwhile, in establishing security of the wireless communications system in a physical layer, by blocking a wiretapper on a network from receiving information transmitted from a user, no data to be restored or analyzed may be provided to the wiretapper. To this end, there has been a demand for a method for establishing security of the network in the physical layer of the wireless communications system.

SUMMARY

In view of the foregoing, example embodiments provide a strategy for improving an achievable secrecy rate in a multiuser mobile radio communications network. Further, example embodiments also provide an optimized jamming signal by calculating an achievable secrecy rate available in the radio communications network where an internal wiretapper exists. In addition, example embodiments also provide a low-complexity jamming strategy which is not sensitive to a change in network size, in consideration of the characteristic of the mobile radio communications network. Furthermore, example embodiments also provide a technique for increasing an achievable secrecy rate in the multiuser mobile radio communications network by generating a jamming signal through the use of multiple antennas by utilizing physical layer security technology.

However, the problems sought to be solved by the present disclosure are not limited to the above description and other problems can be clearly understood by those skilled in the art from the following description.

In one example embodiment, a node device is provided. The node device may include forming a jamming signal generation unit configured to generate a jamming signal for a target signal which is transmitted from a base station to an intended receiving device supposed to receive the signal and an unintended receiving device not supposed to receive the signal, a beamforming vector determination unit configured to determine a beamforming vector of the jamming signal based on an amplitude of a received power of the jamming signal at the intended receiving device, and a transmission unit configured to transmit the jamming signal based on the determined beamforming vector.

In another example embodiment, a method for transmitting a jamming signal is provided. The method may include generating a jamming signal for a target signal, determining a beamforming vector of the jamming signal based on an amplitude of a received power of the jamming signal at an intended receiving device, and transmitting the jamming signal based on the determined beamforming vector. The target signal may be transmitted from a base station to an intended receiving device supposed to receive the signal and an unintended receiving device not supposed to receive the signal.

In accordance with the example embodiments, in a mobile radio communications network with multiuser settings, it may be possible to avoid a risk of wiretapping by internal users who share the same resources. Further, by guaranteeing the security of communication resources in a physical layer, a potential wiretapper may be prevented from obtaining communication resources from a legitimate user. Further, it may be possible to improve an achievable secrecy rate of the mobile radio communications network with multiusers. Moreover, by calculating a secrecy rate available in the mobile radio communications network where an internal wiretapper exists, it may be possible to provide an optimized jamming signal. Further, it may be also possible to provide a low complexity jamming strategy which is insensitive to network side. Moreover, it may be also possible to improve an achievable secrecy rate in the multiuser mobile radio communications system through the use of multiple antennas.

BRIEF DESCRIPTION OF THE DRAWINGS

In the detailed description that follows, embodiments are described as illustrations only since various changes and modifications will become apparent from the following detailed description. The use of the same reference numbers in different figures indicates similar or identical items.

DETAILED DESCRIPTION

Figure 1:
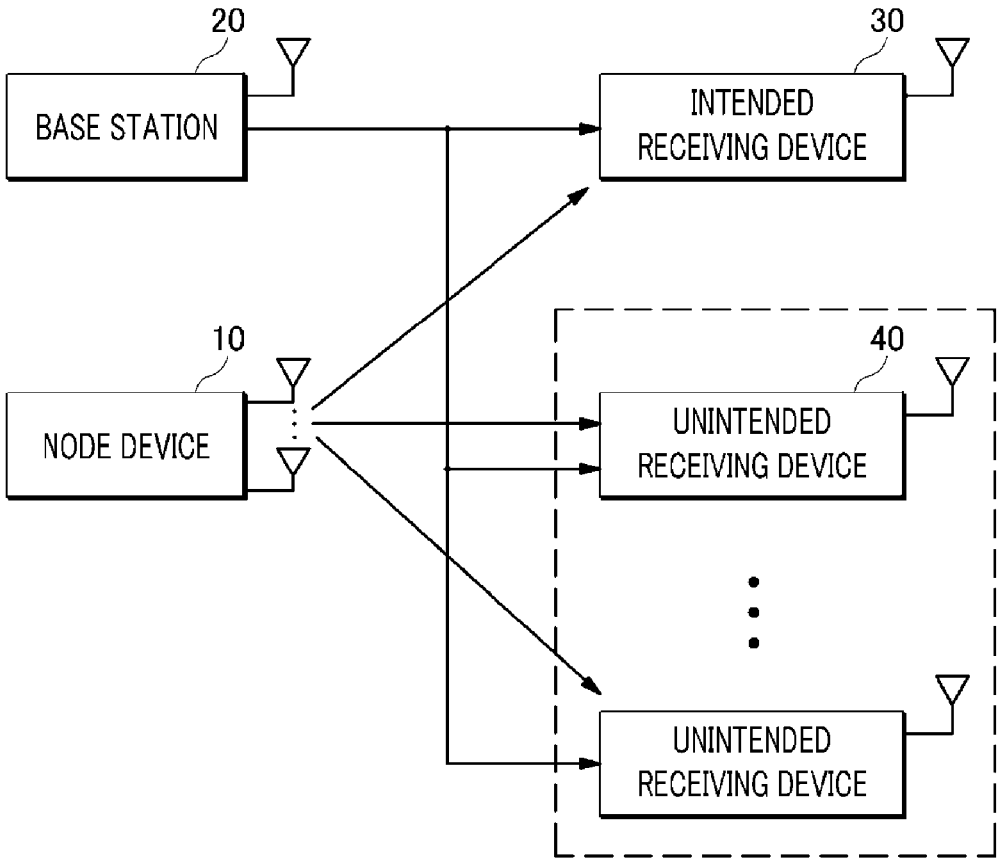
FIG. 1 is a block diagram illustrating a configuration of a wireless communications system in accordance with an example embodiment.

Hereinafter, example embodiments will be described in detail so that inventive concept may be readily implemented by those skilled in the art. However, it is to be noted that the present disclosure is not limited to the illustrative embodiments and examples but can be realized in various other ways. In drawings, parts not directly relevant to the description are omitted to enhance the clarity of the drawings, and like reference numerals denote like parts through the whole document.

Through the whole document, the terms "connected to" or "coupled to" are used to designate a connection or coupling of one element to another element and include both a case where an element is "directly connected or coupled to" another element and a case where an element is "electronically connected or coupled to" another element via still another element.

FIG. 1 is a block diagram illustrating a configuration of a wireless communications system in accordance with an example embodiment. Referring to FIG. 1, the wireless communications system includes a base station 20; an intended receiving device 30 which is supposed to receive a signal transmitted from the base station 20; an unintended receiving device 40 which is not supposed to receive a signal from the base station; and a node device 10.

The node device 10, the base station 20, the intended receiving device 30 and the unintended receiving device 40 may be connected by a network. The network refers to a structure of a multiple number of nodes such as terminals and servers linked together in a wired or wireless manner so that they can exchange information. The network may include, but not limited to, Internet, Wireless LAN (Wireless Local Area Network), WAN (Wide Area Network), PAN (Personal Area Network), mobile radio communication network.

The base station 20 is configured to transmit a signal to a destination, .i.e., to the intended receiving device 30. Meanwhile, the intended receiving device 30 and the unintended receiving device 40 may be located on a wireless network that shares the same communication resources. Among a multiple number of receiving devices located on the wireless network, the other receiving devices except the intended receiving device 30 supposed to be a recipient of a signal from the base station 20 may be assumed to be unintended receiving devices 40. In such a case, each unintended receiving devices 40 may be regarded as a potential wiretapper and may be defined as a wiretapping device.

A general secrecy capacity will be explained in relation to the base station 20, the intended receiving device 30 and an unintended receiving device 41 of FIG. 1. Assume that a single transmitted from the base station 20 is x; a channel between the base station 20 and the intended receiving device 30 is h; and a channel between the base station 20 and the unintended receiving device is g. In this case, signals received at the base station 20 and the unintended receiving device 41 may be given as the follows:

$$y_r = hx + n_r,\ y_e = gx + n_e, \qquad \text{[Equation 1]}$$

wherein $y_r$ represents a signal received at the base station 20; $y_e$ a signal received at the unintended receiving device 41; and $n_r$ and $n_e$ are noises generated at the base station 20 and the intended receiving device 41, respectively, during the reception of the signals. Here, assume that a transmission power of the base station 20 is $P_t$. Then, a secrecy capacity, which implies the maximum data transmission rate at which the base station 20 is capable of transmitting information to the intended receiving device 30 without suffering error or leakage of the information to the unintended receiving device 41, is given as follows:

$$C_{secret} = \left[\log\left(1 + \frac{P_t|h|^2}{\sigma_r^2}\right) - \log\left(1 + \frac{P_t|g|^2}{\sigma_e^2}\right)\right]^+, \qquad \text{[Equation 2]}$$

wherein $\sigma_r^2$ and $\sigma_e^2$ indicate dispersals of noises according to Gaussian distribution at the intended receiving device 30 and the unintended receiving device 41, respectively; h, the channel between the base station 20 and the intended receiving device 30; and g, the channel between the base station 20 and the unintended receiving device 41. Further, $[A]^+$ denotes max (A, 0) and implies that a larger one of the values A and 0 is selectable. Conceptually, Equation 2 is for calculating a value of secrecy capacity by subtracting a capacity of the channel between the base station 20 and the unintended receiving device 41 from a capacity of the channel between the base station 20 and the intended receiving device 30. Depending on the states of the channels, if the channel between the base station 20 and the unintended receiving device 41 is better than the channel between the base station 20 and the intended receiving device 30, the secrecy capacity may have a value of zero. Since the states of the wireless communication channels vary frequently, the secrecy capacity may also vary frequently.

A channel transfers information signals over time and space, and it implies an information transfer capacity allotted between the base station 20 and a receiving device. Here, the channel may be a logical or a complex signal path rather than a physical transmission path, and a single channel may further include a multiple number of communication channels. Meanwhile, the channel may further include channel states information (CSI) indicating registration information of the channel in the wireless network environment. The channel states information (CSI) may be classified into short-term CSI indicating a current state of the channel and long-term CSI indicating statistical characteristics of the channel.

The node device 10 is capable of enhancing the secrecy capacity between the base station 20 and the intended receiving device 30 by using a multiple antenna signal processing technique. A secrecy capacity will be explained in relation to the node device 10, the base station 20, the intended receiving device 30 and the unintended receiving device 41 of FIG. 1. By using a beamforming vector which is used by the node device 10 to transmit a jamming signal to a plurality of receiving devices through the use of at least one antenna, a secrecy capacity is given as the following equation:

$$R_{secret} = \left[\log\left(1 + \frac{P_t|h_{11}|^2}{\sigma_r^2 + |w^* h_{21}|^2}\right) - \log\left(1 + \frac{P_t|h_{22}|^2}{\sigma_e^2 + |w^* h_{12}|^2}\right)\right]^+, \qquad \text{[Equation 3]}$$

wherein $P_t$ denotes a maximum transmission power of a transmission end and the node device 10. In Equation 3, if a transmission beamforming vector w of the node device 10 is calculated, it may be possible to solve the problem of dependency of secrecy capacity on the channel state of the unintended receiving device 41. That is, even if the channel state between the base station 20 and the intended receiving device 30 is worse than the channel state between the base station 20 and the unintended receiving device 41, it may be still possible to provide a high secrecy capacity by the aid of the node device 10.

In case that the unintended receiving device 41 assumed to be a wire-tapping device exists in a multiuser mobile radio communications system, the node device 10 generates a jamming signal contributing to the increase of secrecy capacity, thus improving security of the intended receiving device 30 communicating with the base station 20. At this time, the node device 10 may be designed to be of low complexity so as not to be sensitive to network size.

Now, an operation of the node device 10 will be elaborated below.

Figure 2:
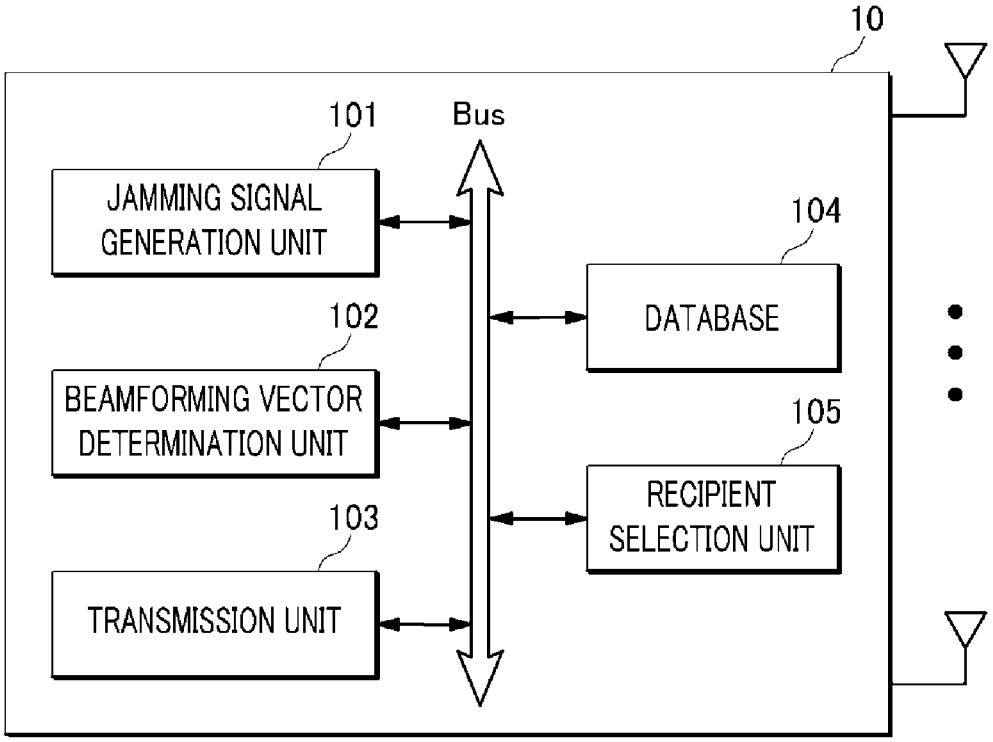
FIG. 2 is a block diagram illustrating a node device in accordance with the example embodiment.

FIG. 2 is a block diagram illustrating a configuration of the node device 10 in accordance with the example embodiment. As depicted in FIG. 2, the node device 10 includes a signal generation unit 101, a beamforming vector determination unit 120, a transmission unit 103, a database 104 and a recipient selection unit 105. Here, it would be understood by those skilled in the art that various changes and modifications may be made based on the constituent components shown in FIG. 2.

The jamming signal generation unit 101 is configured to generate a jamming signal for a certain signal. At this time, the certain signal may be transmitted from the base station 20 to the intended receiving device 30 supposed to receive the signal and to the unintended receiving device 40 not supposed to receive the signal. The jamming signal may be defined as a strong signal that overlaps with a target signal or weakens the target signal. The jamming signal may be an interference signal intentionally generated to disrupt a radio frequency or a laser in wartime. As for principle of the jamming signal, in general, a noise is tuned to an exact frequency of a signal as a target of jamming, and this modulated signal is transmitted through a strong radio signal.

By way of example, in a wireless network environment where K number of receiving devices exist, it is assumed that K−1 number of receiving devices except the intended receiving device 30 communicating with the base station 20 are unintended receiving devices 40. In order to avoid the risk of wiretapping from the unintended receiving devices 40, the base station 20 may cooperate with the node device 10 and achieve improvement of secrecy capacity through the use of a jamming signal generated in the jamming signal generation unit 101 of the node device 10.

In the following description, for the simplicity of explanation, it is assumed that only the node device 10 has $N_H$ number of multiple antennas, whereas each of the base station 20, the intended receiving device 30 and the unintended receiving devices 40 has a single antenna, and the number of the antennas of the node device 10 satisfies a condition of $N_H \geq K$. It is also assumed that a transmission power $P_B$ of the base station 20 and a transmission power $P_H$ of the node device 10 satisfy a condition of $P_B = P_H = 1$ within a range without hampering problem solution.

The beamforming vector determination unit 102 is configured to determine a beamforming vector of the jamming signal in consideration of the amplitude of a received power of the jamming signal at the intended receiving device 30. The beamforming vector determined by the beamforming vector determination unit 102 may satisfy a condition of the following equation:

$$\|W\|^2 \leq 1 \qquad \text{[Equation 4]}$$

When the beamforming vector is determined by the beamforming vector determination unit 102, a secrecy capacity of the intended receiving device 30 communicating with the base station 20 can be calculated by the following equation.

$$\begin{aligned} R_i^S &\overset{(a)}{=} \max_w \left[\log\left(1+\frac{|h_i|^2}{\sigma_i^2+|w^* g_i|^2}\right) - \max_{j\neq i, j\in\mathcal{K}} \log\left(1+\frac{|h_j|^2}{\sigma_j^2+|w^* g_j|^2}\right)\right]^+ \\ &\overset{(b)}{=} \max_w \min_{j\neq i, j\in\mathcal{K}} \left[\log\left(1+\frac{|h_i|^2}{\sigma_i^2+|w^* g_i|^2}\right) - \log\left(1+\frac{|h_j|^2}{\sigma_j^2+|w^* g_j|^2}\right)\right]^+ \end{aligned} \qquad \text{[Equation 5]}$$

In Equation 5, $h_k$ and $g_k$ denote a channel coefficient and a channel vector between the base station 20 and the $K^{th}$ receiving device, respectively; and $\sigma_k^2$ indicates a dispersal of noise according to Gaussian distribution at the $K^{th}$ receiving device. In this case, all elements of the channel coefficient or the channel vector are independent and accord to Gaussian distribution of a complex number with an average of 0 and a dispersal of 1. Further, all noises accord to Gaussian distribution of a complex number with an average of 0 and a dispersal of $\sigma_k^2$.

Meanwhile, in the wireless network environment where K number of receiving devices exist, it is assumed that K−1 number of receiving devices except the intended receiving device 30 communicating with the base station 20 are the unintended receiving devices 40. Among the K−1 number of unintended receiving devices 40, an unintended receiving device 41 capable of tapping a maximum amount of signals transmitted between the base station 20 and the intended receiving device 30 is defined as a best tapper j*, and the best tapper j* can be defined as the following equation.

$$j^* = \underset{j\neq i, j\in\mathcal{K}}{\operatorname{argmax}} \log\left(1+\frac{|h_j|^2}{\sigma_j^2+|w^* g_j|^2}\right) \qquad \text{[Equation 6]}$$

The beamforming vector determination unit 102 determines a beamforming vector $w_i^{opt}$ to satisfy the following equation 7 for calculating a secrecy capacity to generate minimal interference to the intended receiving device 40 and maximal interference to the K−1 number of unintended receiving devices 40.

$$\begin{aligned} P1:\ &\max_w \min_{j\neq i, j\in\mathcal{K}} \left[\log\left(1+\frac{|h_i|^2}{\sigma_i^2+|w^* g_i|^2}\right) - \log\left(1+\frac{|h_j|^2}{\sigma_j^2+|w^* g_j|^2}\right)\right]^+ \\ &\text{s.t. } \|w\|^2 \leq 1. \end{aligned} \qquad \text{[Equation 7]}$$

The beamforming vector $w_i^{opt}$, which is determined by the beamforming vector determination unit 102 so as to generate the minimal interference to the intended receiving device 30 and the maximal interference to the unintended receiving devices 40, is as follows:

$$\begin{aligned} &w_i^{opt} = v_{max}\{Z\},\ Z = \sum_{k=1}^{K} e_k \lambda_k g_k g_k^*, \\ &\lambda_k \in [0, 1],\ \sum_{k=1}^{K} \lambda_k = 1 \\ &\text{and} \\ &\hat{e} = \begin{cases} e_k = -1 & \text{for } k = i \\ e_k = +1 & \text{for } k \neq i \end{cases}. \end{aligned} \qquad \text{[Equation 8]}$$

In Equation 8, $v_{max}\{Z\}$ denotes a principal eigenvector of Z having an eigenvalue. Equation 8 requires some set of K number of real-valued parameters $\lambda_k$ that satisfy a condition that the sum of the real-valued parameters amounts to 1. The beamforming vector determination unit 102 may determine the K number of parameters by exhaustive searching for searching for a value that maximizes a secrecy capacity by substituting K−1 number of parameters to Equation 8.

The beamforming vector $w_i^{opt}$ determined by Equation 8 may be greatly affected by the number of network users and a searching resolution for the searching for the real-valued parameters.

The database 104 may store therein the first channel information between the node device 10 and the intended receiving device 30, the second channel information between the node device 10 and the unintended receiving device 40, the third channel information between the base station 20 and the intended receiving device 30 and the fourth channel information between the base station 20 and the unintended receiving device 40.

If the database 104 stores therein only the first channel information and the second channel information and, thus, channel information between the base station 20 and the receiving devices is not informed, this case is called "partial cooperation." In case of partial cooperation, the beamforming vector determination unit 102 may determine a beamforming vector $w_i^{partial\ coop}$. To elaborate, in case of partial cooperation, since the best tapper j* is not known, the beamforming vector determination unit 102 may determine the beamforming vector $w_i^{partial\ coop}$ based on the first channel information and the second channel information within a range where interference does not occur. The reason for this operation is to transmit a jamming signal within a range where interference is not caused to the intended receiving device 30. The beamforming vector determination unit 102 may determine the beamforming vector $w_i^{partial\ coop}$ according to Equation 10 so as to satisfy Equation 9. Equation 9 is a standard problem in the field of wireless communications, and a solution to this is well-known as a zero forcing (ZF) beamforming technique. Further, in Equations 9 and 10, $g_i$ denotes the intended receiving device 30, and $P_{g_i}^{\perp}$ represents a orthographic projection of the generated jamming signal to the intended receiving device 30.

$$P3:\ \min_w |w^* g_i|^2 \quad \text{s.t. } \|w\|^2 \le 1 \qquad \text{[Equation 9]}$$

$$w_i^{partial\ coop} = \frac{P_{g_i}^{\perp}\left(\sum_{j\in K, j\neq i}^{K} g_j\right)}{\left\|P_{g_i}^{\perp}\left(\sum_{j\in K, j\neq i}^{K} g_j\right)\right\|}. \qquad \text{[Equation 10]}$$

The beamforming vector determination unit 102 may determine the beamforming vector $w_i^{partial\ coop}$ such that a received power of a jamming signal at the intended receiving device is minimized, i.e., such that the received power of the jamming signal at the intended receiving device 30 becomes zero.

The recipient selection unit 105 may select a first unintended receiving device 41 among the multiplicity of unintended receiving devices based on the third channel information or the fourth channel information stored in the database 103. In case that the third channel information or the fourth channel information is stored in the database 104 and the recipient selection unit 105 selects the first unintended receiving device 41, this case is called "full cooperation."

In case of full cooperation, the beamforming vector determination unit 102 may determine a beamforming vector of a jamming signal in consideration of a first received power of the jamming signal at the intended receiving device 30 and a second received power of the jamming signal at the first unintended receiving device 41. That is, in case of full cooperation, it is possible to identify the first unintended receiving device 41, which is the best tapper j* of the intended receiving device 30 by using the channel information of the base station 20. In this case, the beamforming vector determination unit 102 may determine the beamforming vector $w_i^{full\ coop}$ so as to minimize the first received power while maximizing the second received power such that jamming is conducted only for the best tapper j*. The beam forming vector $w_i^{full\ coop}$ may be calculated by Equation 12 to satisfy the following Equation 11.

$$P2:\ \max_w \left[\log\left(1+\frac{|h_i|^2}{\sigma_i^2+|w^* g_i|^2}\right)-\log\left(1+\frac{|h_{j^*}|^2}{\sigma_{j^*}^2+|w^* g_{j^*}|^2}\right)\right]^+ \quad \text{s.t. } \|w\|^2 \le 1. \qquad \text{[Equation 11]}$$

$$w_i^{full\ coop} = \frac{\lambda w_{ZF} + (1-\lambda) w_{MRT}}{\|\lambda w_{ZF} + (1-\lambda) w_{MRT}\|} \qquad \text{[Equation 12]}$$

Here, the real-valued parameter satisfies a condition of $0 \le \lambda \le 1$, and there are established relationships of $w_{MRT} = g_{j^*}/\|g_{j^*}\|$ and $w_{ZF} = P_{g_i}^{\perp} g_{j^*}/\|P_{g_i}^{\perp} g_{j^*}\|$. $W_{MRT}$ is a beamforming vector that provides a maximum received power at the unintended receiving device, and $W_{ZF}$ is a beamforming vector that reduces a received power of a jamming signal generated at the intended receiving device 30 to zero. The beamforming vector $w_i^{full\ coop}$ is composed of a linear combination of $W_{MRT}$ and $W_{ZF}$.

The transmission unit 103 transmits a jamming signal based on the determined beamforming vector. By way of example, the transmission unit 103 may transmit a jamming signal generated for the multiplicity of unintended receiving devices 40 based on the beamforming vector $w_i^{partial\ coop}$ determined for the case of partial cooperation. Further, the transmission unit 103 may also transmit a jamming signal generated for the first unintended receiving device 41, which is the best tapper tapper j* based on the beaming-forming vector $w_i^{full\ coop}$ determined for the case of full operation. The transmission unit 103 may transmit the jamming signals through multiple antennas.

Figure 3:
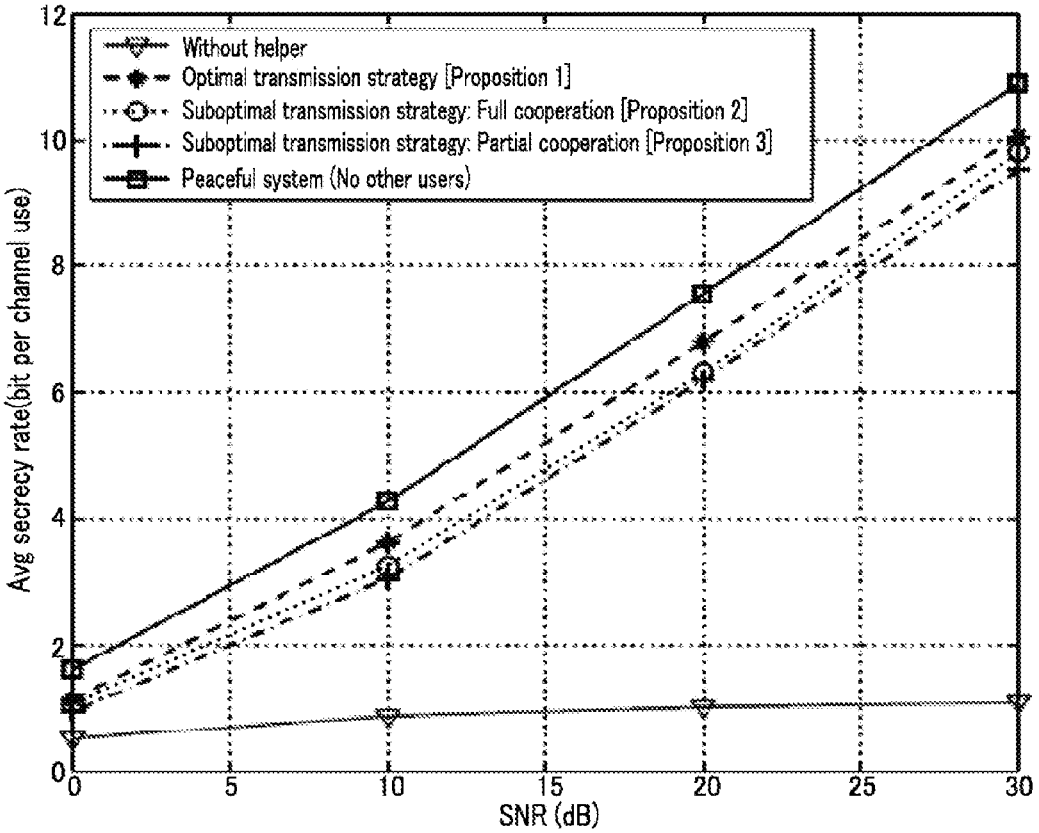
FIG. 3 is a graph showing an achievable secrecy rate in accordance with the example embodiment.

FIG. 3 is a graph showing an achievable secrecy rate in accordance with the example embodiment. As can be seen from FIG. 3, when the node device 10 determines the beamforming vector $w_i^{opt}$, the highest achievable secrecy rate is provided. Further, in comparison with the case of the beamforming vector $w_i^{opt}$, an achievable secrecy rate in case of determining the beamforming vector $w_i^{full\ coop}$ of full operation and an achievable secrecy rate in case of determining the beamforming vector $w_i^{partial\ coop}$ of partial cooperation are reduced just slightly as compared to a great reduction in computational complexity. Through this analysis, it is proved that security against the unintended receiving device 40 can be improved by using the node device 10.

Table 1 shows computational complexities according to the determined beamforming vectors of the node device 10. Referring to the computational complexities shown in Table 1, the computational complexity according to the determined beamforming vector $w_i^{opt}$ depend on parameters such as the number of the network users, the number of the antennas of the node device 10, the resolution of the real-valued parameter, etc. Further, it is found out that the computational complexity according to the determined beamforming vector increases geometrically as the network size increases. Further, it is also observed that the determined beamforming vector $w_i^{opt}$ requires a highly complicated operation such as Eigen decomposition. Thus, computational complexity of the beamforming vector $w_i^{opt}$ is very high. In contrast, the computational complexity according to the beamforming vector $w_i^{full\ coop}$ in case of full operation only relies on the real-valued parameter and the number of the antennas of the node device 10 regardless of the number of the network users.

Thus, the beamforming vector $w_i^{full\ coop}$ is less sensitive to a network size. Further, by diminishing an exhaustive searching process of searching for K−1 number of optimal real-valued parameters to an exhaustive searching process of searching for a single real-valued parameter, computational complexity is reduced greatly. Further, in case of the computational complexity according to the beamforming vector $w_i^{partial\ coop}$, a real-valued parameter requiring exhaustive searching is removed, and, thus, computational complexity is reduced.

TABLE 1

| | Beamforming vector $w_i^{opt}$ | Beamforming vector $w_i^{full\ coop}$ in full cooperation | Beamforming vector $w_i^{partial\ coop}$ in partial coopeation |
|---|---|---|---|
| Multiplication | $O(\rho^{(K-1)}KN_H^2)$ | $O(\rho N_H^2)$ | $O(N_H^2)$ |
| Addition | $O(\rho^{(K-1)}KN_H^2)$ | $O(\rho N_H^2)$ | $O(N_H^2) + O(KN_H)$ |
| Eigen decomposition | $O(\rho^{(K-1)}N_H^3)$ | | |
| Total | $O(\rho^{(K-1)}KN_H^2) + O(\rho^{(K-1)}N_H^3)$ | $O(\rho N_H^2)$ | $O(N_H^2) + O(KN_H)$ |
| Total ($N_H = K = n$) | $O(\rho^{(n-1)}n^3)$ | $O(\rho n^2)$ | $O(n^2)$ |

Figure 4:
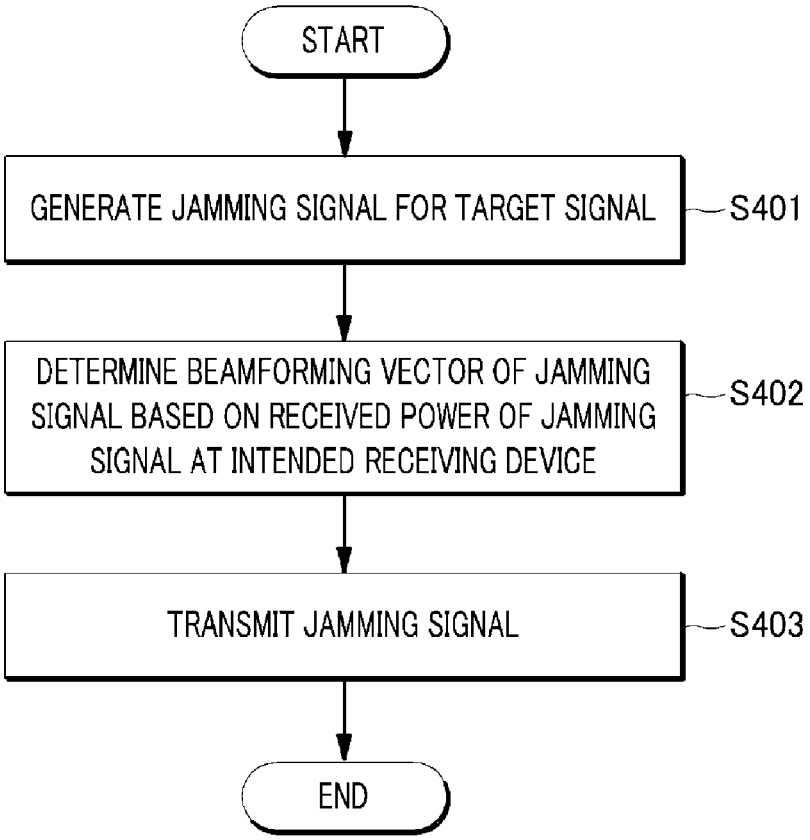
FIG. 4 is a flowchart for describing an operation of the node device which is in partial cooperation with a base station in accordance with the example embodiment.

FIG. 4 is a flowchart for describing an operational sequence of a node device which is in partial cooperation with the base station in accordance with an example embodiment. FIG. 4 includes processes performed in the node device 10 shown in FIG. 1 in a time sequential order. Thus, although omitted here, the same description of the node device 10 as stated above in conjunction with FIG. 1 and FIG. 2 may also be applied to the example embodiment of FIG. 4.

Referring to FIG. 4, the node device 10 generates a jamming signal for a certain signal (S401). At this time, the certain signal may be transmitted from the base station 20 to the intended receiving device 40 supposed to receive the signal and to the unintended receiving device 40 which is not supposed to receive the signal. Then, based on the first channel information or the second channel information of the node device 10 stored in the database 104, the node device 10 determines a beamforming vector of the jamming signal in consideration of a received power of the jamming signal at the intended receiving device 30 (S402). Then, the node device 10 transmits the jamming signal based on the determined beamforming vector (S403).

FIG. 4 illustrates an example where the jamming signal is transmitted based on the beamforming vector determined for the case of partial cooperation. The jamming signal may be transmitted so as to minimize the received power of the jamming signal at the intended receiving device.

Figure 5:
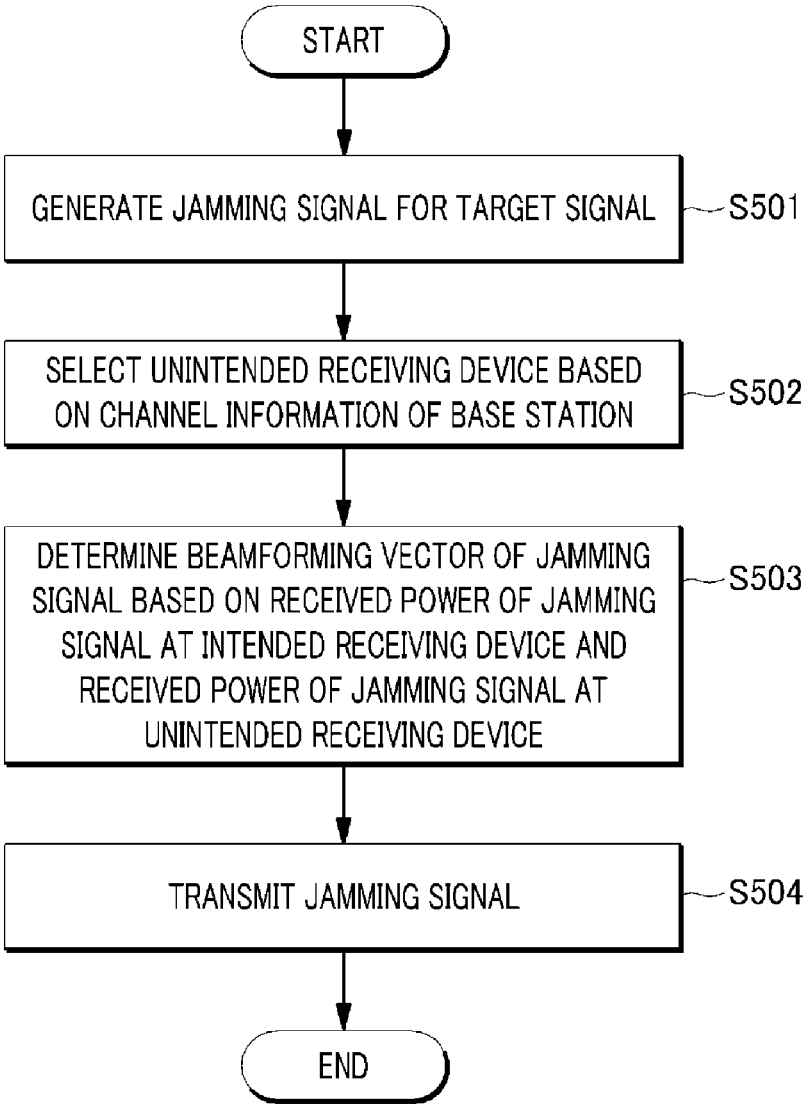
FIG. 5 is a flowchart for describing an operation of the node device which is in full operation with a base station in accordance with the example embodiment.

FIG. 5 is a flowchart for describing an operational sequence of the node device which is in full cooperation with the base station in accordance with an example embodiment. FIG. 54 includes processes performed in the node device 10 shown in FIG. 1 in a time sequential order. Thus, although omitted here, the same description of the node device 10 as stated above in conjunction with FIG. 1 and FIG. 2 may also be applied to the example embodiment of FIG. 5.

Referring to FIG. 5, the node device 10 generates a jamming signal of a certain signal (S501). At this time, the certain signal may be transmitted from the base station 20 to the intended receiving device 40 supposed to receive the signal and to the unintended receiving device 40 not supposed to receive the signal. Then, based on the third channel information or the fourth channel information of the base station 20, the node device 10 selects an unintended receiving device 41, which is the best tapper (S502). Then, the node device 10 determines a beamforming vector of the jamming signal in consideration of a received power of the jamming signal at the intended receiving device 30 and a received power of the jamming signal at the unintended receiving device (S503). Then, the node device 10 transmits the jamming signal based on the determined beamforming vector (S504).

FIG. 5 illustrates an example where the jamming signal is transmitted based on the beamforming vector determined for the case of full cooperation. The jamming signal may be transmitted so as to minimize interference to the intended receiving device and maximize interference to the unintended receiving device 41.

The jamming signal transmission methods described in FIG. 4 and FIG. 5 may be implemented in the form of a storage medium including computer executable commands, such as a program module to be executed by a computer. The computer readable storage medium may be any available medium that can be accessed by a computer, and includes volatile, nonvolatile, removable and non-removable storage media. Further, the computer readable storage medium may include both a computer storage medium and a communication medium. The computer storage medium may include volatile, nonvolatile, removable and non-removable media implemented by a method or a technology for data storage, such as computer readable commands, data structure, program module, data, etc. The communication medium may typically include computer readable commands, data structure, program module, data of modulated data signal such as carrier wave, or transmission mechanism, and also includes an information delivery medium.

The above description of the illustrative embodiments is provided for the purpose of illustration, and it would be understood by those skilled in the art that various changes and modifications may be made without changing technical conception and essential features of the illustrative embodiments. Thus, it is clear that the above-described illustrative embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the illustrative embodiments. It shall be understood that all modifications and embodiments conceived from the meaning and scope of the claims and their equivalents are included in the scope of the inventive concept.

We claim:

1. A node device, comprising:

a jamming signal generation unit configured to generate a jamming signal for a target signal which is transmitted from a base station to an intended receiving device supposed to receive the signal and an unintended receiving device not supposed to receive the signal;

a beamforming vector determination unit configured to determine a beamforming vector of the jamming signal based on an amplitude of a received power of the jamming signal at the intended receiving device;

a transmission unit configured to transmit the jamming signal based on the determined beamforming vector;

a database storing therein first channel information upon a first channel between the node device and the intended receiving device, second channel information upon a second channel between the node device and the unintended receiving device, third channel information upon a third channel between the base station and the intended receiving device, and fourth channel information upon a fourth channel between the base station and the unintended receiving device; and a recipient selection unit configured to select a first unintended receiving device among a plurality of unintended receiving devices based on at least one of the third channel information and the fourth channel information, wherein the beamforming vector determination unit determines a beamforming vector of the jamming signal based on a first received power of the jamming signal at the intended receiving device and a second received power of the jamming signal at the first unintended receiving device.

2. The node device of claim 1, wherein the beamforming vector determination unit determines the beamforming vector of the jamming signal such that the received power of the jamming signal at the intended receiving device is minimized.

3. The node device of claim 1, wherein the beamforming vector determination unit determines the beamforming vector of the jamming signal such that the received power of the jamming signal at the intended receiving device becomes zero.

4. The node device of claim 1, wherein the beamforming vector determination unit determines the beamforming vector of the jamming signal such that the first received power of the jamming signal is minimized while the second received power of the jamming signal is maximized.

5. The node device of claim 1, wherein the transmission unit transmits the jamming signal through a plurality of antennas.

6. A method for transmitting a jamming signal, the method comprising:

generating a jamming signal for a target signal;

determining a beamforming vector of the jamming signal based on an amplitude of a received power of the jamming signal at an intended receiving device;

transmitting the jamming signal based on the determined beamforming vector, wherein the target signal is transmitted from a base station to an intended receiving device supposed to receive the signal and an unintended receiving device not supposed to receive the signal, storing first channel information upon a first channel between the node device and the intended receiving device, second channel information upon a second channel between the node device and the unintended receiving device, third channel information upon a third channel between the base station and the intended receiving device, and fourth channel information upon a fourth channel between the base station and the unintended receiving device; and selecting a first unintended receiving device among a plurality of unintended receiving devices based on at least one of the third channel information and the fourth channel information, wherein the determining of the beamforming vector includes determining the beamforming vector of the jamming signal is determined based on a first received power of the jamming signal at the intended receiving device and a second received power of the jamming signal at the first unintended receiving device.

7. The method of claim 6, wherein the determining of the beamforming vector includes determining the beamforming vector of the jamming signal such that a received power of the jamming signal at the intended receiving device is minimized.

* * * * *